United States Patent [19]

Canela

[11] Patent Number: 5,012,831

[45] Date of Patent: May 7, 1991

[54] VANITY AND HAIR BRUSH COMBINATION

[76] Inventor: Heriberto Canela, 8027 W. 14 Ave., Hialeah, Fla. 33014

[21] Appl. No.: 384,387

[22] Filed: Jul. 25, 1989

[51] Int. Cl.[5] ..... A45D 40/18

[52] U.S. Cl. ..... 132/313; 132/286

[58] Field of Search ..... 132/286, 102, 147, 313, 132/314; 15/105

[56] References Cited

U.S. PATENT DOCUMENTS

| | | | |
|---|---|---|---|
| 1,394,837 | 10/1921 | James | 132/313 |
| 1,397,403 | 11/1921 | Chrobak | 132/313 |
| 1,504,597 | 8/1924 | Bayron | 132/313 |
| 1,727,007 | 9/1929 | eyster | 132/313 |
| 1,831,667 | 11/1931 | Johnson | 132/313 |
| 1,991,867 | 2/1935 | Riciputi et al. | 132/313 |
| 2,097,938 | 11/1937 | Sundin | 132/313 |
| 2,933,092 | 4/1960 | McDunnah | 132/147 |

*Primary Examiner*—Gene Mancene
*Assistant Examiner*—Michael Lynch
*Attorney, Agent, or Firm*—J. Sanchelima

[57] ABSTRACT

A hair brush device with an elongated handle and a powder compartment mounted to one end. The power compartment includes a bottom surface and a perpendicularly extending peripheral wall that includes bristles perpendicularly mounted to the bottom wall and protrude outwardly through its outer surface. A cover is hingedly and removably mounted to the powder compartment and has an internal surface further including a mirror member mounted thereon. The handle member comprises two halves that are longitudinally joined together by hinges and cooperatively define several cavities for storing cosmetics and applicators.

6 Claims, 3 Drawing Sheets

VANITY AND HAIR BRUSH COMBINATION

BACKGROUND OF THE INVENTION

1. Field of the Invention

The present invention relates to hair brushes, and more particularly, to such brushes that include a vanity mirror and compartments for other popular accessories and products.

2. Description of the Related Art

There have been many designs for hair brushes that include a number of accessories for grooming in the past. However, none of these devices have combined the features of the present invention, including a detachable vanity mirror, that provide a volumetric efficient storage of the different accessories and products typically used by women to fix their hair, powder their faces and color their eyelashes, and other areas of their faces.

SUMMARY OF THE INVENTION

It is one of the main objects of the present invention to provide a device that includes a brush, a detachable vanity mirror, a compartment for powder and its applicator, a compartment for eye shadow colors with its applicator.

It is another object of this invention to provide a device that efficiently stores all the necessary products and accessories typically used by a woman to groom herself.

It is yet another object of the present invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figures 1, 1A:
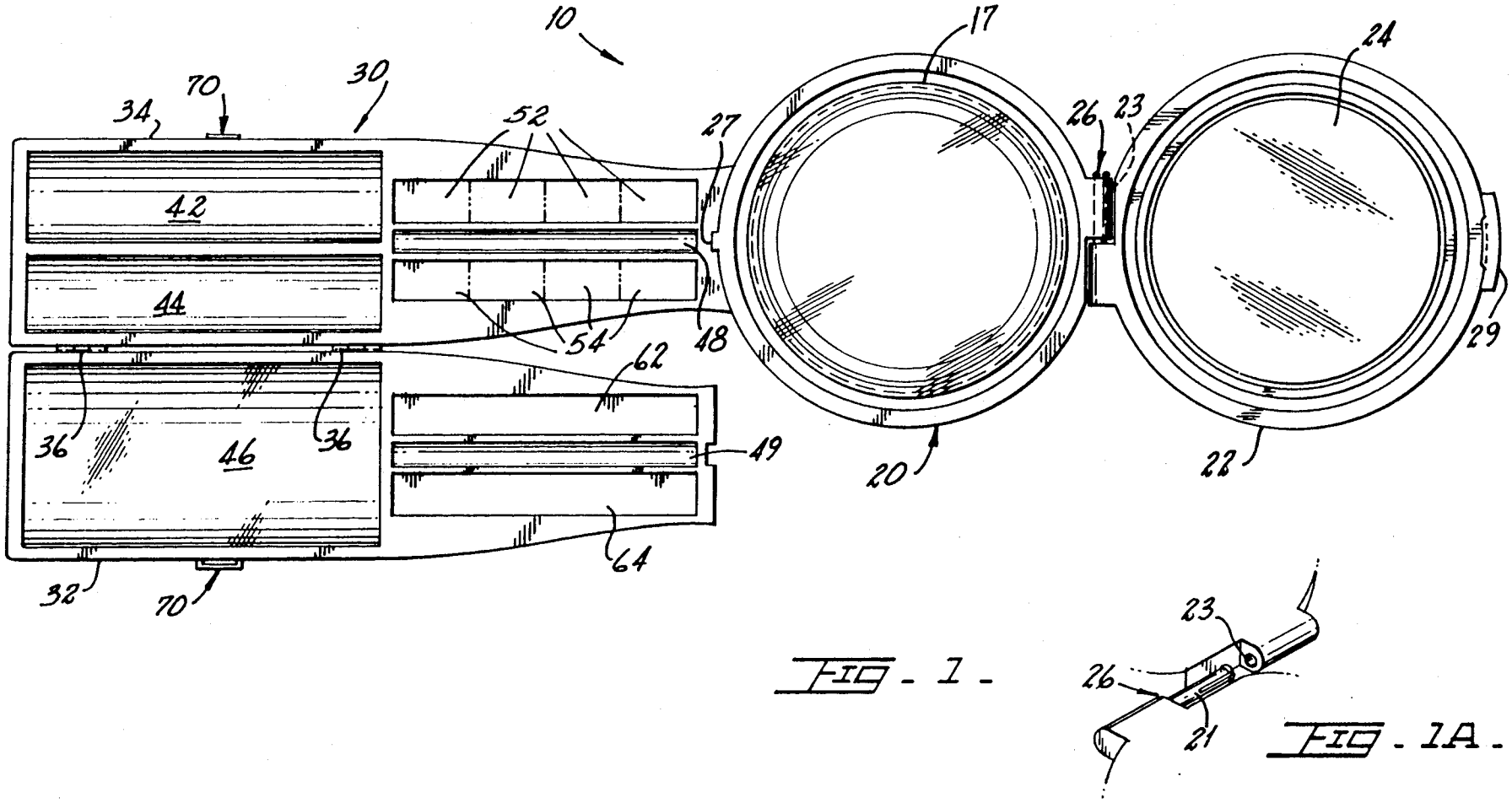
FIG. 1 represents a top view of the present invention showing the cover of the powder compartments in the open position and the eye shadow compartment also in the open position.
FIG. 1A represent a partial cross-sectional view of the detachable hinge assembly used to mount the cover member to the powder compartment.
Figure 2:
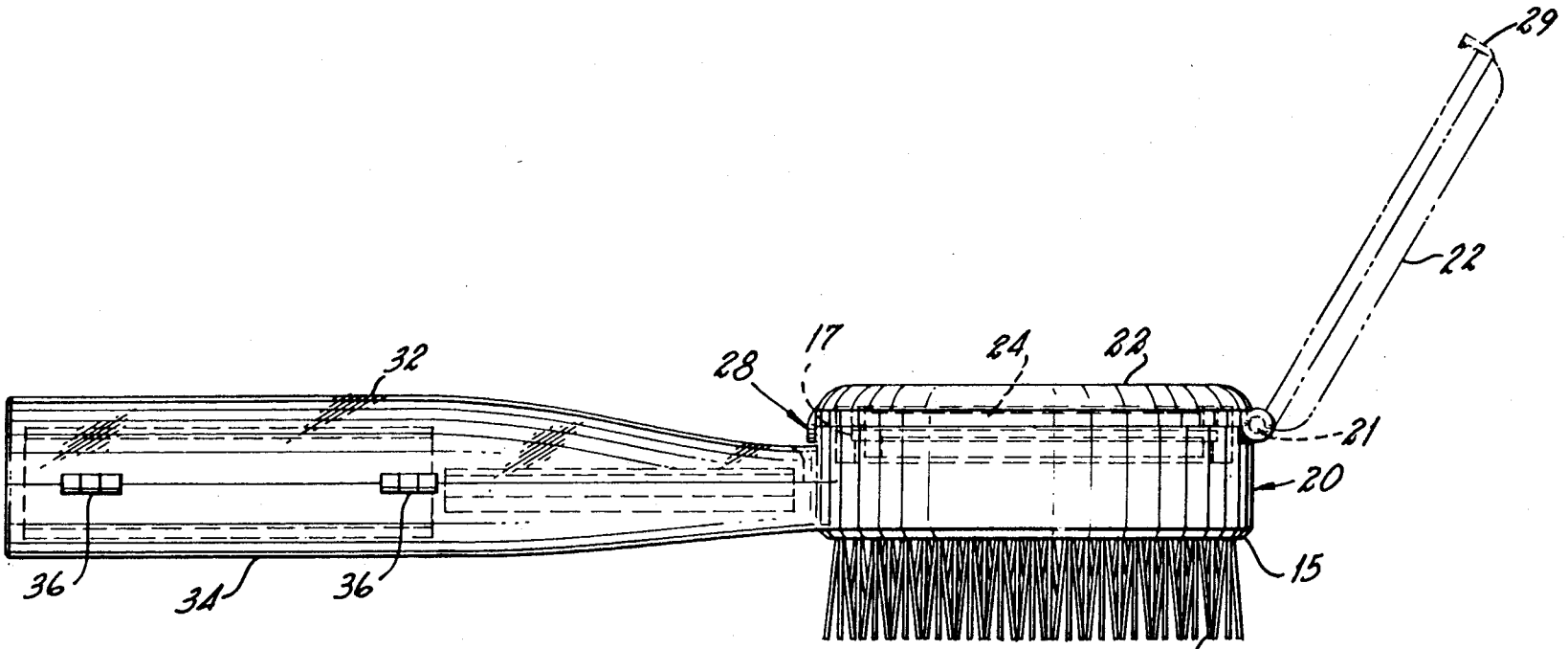
FIG. 2 shows a side view of the device shown in FIG. 1.
Figure 3:
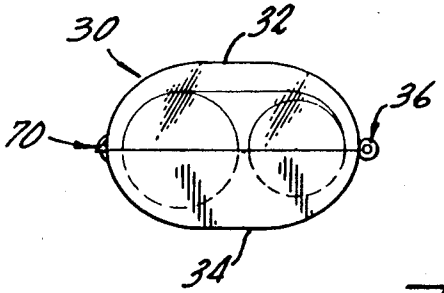
FIG. 3 illustrates an end view of the handle of the device shown in the previous figure.
Figure 7:
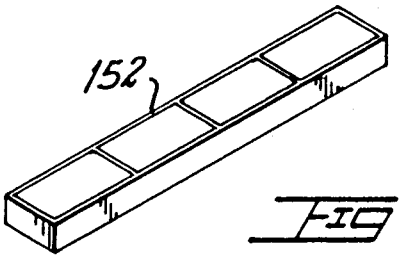
FIG. 7 is a tray with four compartments for eye shadow products.

Referring now to FIG. 1, where the present invention is generally referred to with numeral 10, it can be observed that it basically includes a powder compartment 20 on one end and a handle member 30 at the other end. Powder compartment 20 has, in the preferred embodiment, a round shape and it includes a bottom surface 15 through which bristles 18 protrude perpendicularly thereto, as best seen in FIG. 2. Lid 17 is snapped in place and prevents the powder product from falling off when a user brushes his or her hair. Cover member 22 is hingedly and detachably mounted to compartment 20 by hinge assembly 26. Cover member 22 includes a mirror 24 that is rigidly mounted to the internal surface of cover member 22. Hinge assembly 26 is of the type that can be easily snapped out and snapped in so that a user can readily see herself in the mirror. Hinge assembly 26 includes male stem 21 which removably and snugly fits inside cavity 23, as best seen in FIG. 1A. A locking assembly 28 includes tab member 27 that cooperatively engages with angled flange 29.

Figure 8:
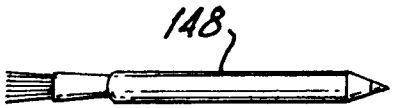
FIG. 8 shows an eyebrown pencil and applicator to be used in conjunction with the present application.
Figure 9:
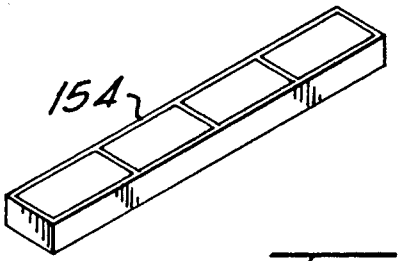
FIG. 9 represents a tray with four compartments for blush products.
Figure 4:
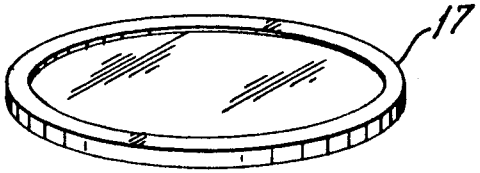
FIG. 4 represents a cover for the powder compartment.
Figure 5:
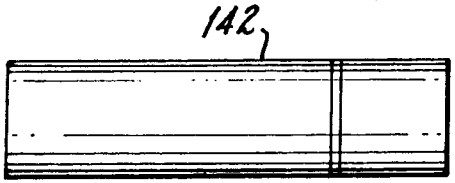
FIG. 5 is a representation of a lipstick.
Figure 6:
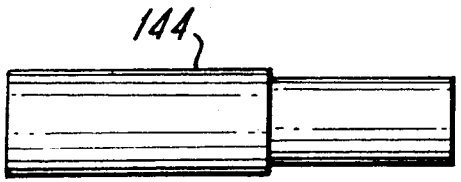
FIG. 6 shows a mascara tube.

Handle member 30 is preferably composed of two longitudinal halves 32 and 34 that are hingedly mounted to each other with hinge assemblies 36. Handle member halves 32 and 34 cooperatively form a plurality of compartments to house products and accessories commonly used. In the preferred embodiment, there are two longitudinal cavities 42 and 44 formed on handle half 34 for receiving lipstick 142 and mascara 144 items shown in FIGS. 5 and 6. Complementing cavity 46 in handle half 32 does not need to be divided. The inner portion of handle member 30 includes central and longitudinally disposed cavities 48 and 49 on both halves 32 and 34 and intended for receiving an eyebrown pencil 148, preferably of the type that includes a lead portion on one end for coloring the user's eyebrows and the other end having an eye shadow applicator, as best seen in FIG. 8. Cavities 52 and 54 adjoining cavity 48 are intended to receive eye shadow 152 and blush 154 products. Complementing cavities 62 and 64 on handle half 32 are cooperatively positioned opposite to cavities 52 and 54 to permit eye shadow 152 and blush 154 products and their containers to be removably mounted thereon. Locking assembly 70 comprises a mechanism for keeping handle halves 32 and 34 against each other while at the same it is relatively easy for a user to open it when desired. In the prefered embodiment, handle half 32 is made out of a transparent material so that a user can see the products contained therein.

It is believed the foregoing description conveys the best understanding of the objects and advantages of the present invention. Different embodiments may be made of the inventive concept of this invention. It is to be understood that all matter disclosed herein is to be interpreted merely as illustrative, and not in a limiting sense.

What is claimed:

1. A hair brush device, comprising:

A. elongated handle means having two ends wherein said elongated handle means is hollow and comprises two substantially symmetrical longitudinal halves that are hingedly mounted with respect to each other and defining a plurality of cavities therein; and B. powder compartment means mounted to one of said ends and said powder compartment means including a bottom surface and perpendicularly extending peripheral walls and further including bristles perpendicularly mounted to an outer surface of said bottom surface;

C. cover means hingedly and removably mounted to said powder compartment means and having an internal surface further including a mirror member mounted to said internal surface, a lid member removably secured above said bottom surface and snugly housed within said peripheral walls so that a compartment is defined therein for the storage of powder and said powder stored therein does not escape from said compartment when said cover means is removed by a user.

2. The hair brush device set forth in claim 1, wherein said cover means includes locking means for keeping said cover means detachably secured to said powder compartment means.

3. The hair brush device set forth in claim 2 wherein said elongated handle means includes a first longitudinally extending cavity centrally positioned and further includes an eye pencil having a color lead on one end and a brush on the other end and said eye pencil being housed within said slot.

4. The hair brush device set forth in claim 3 wherein said handle means includes a plurality of cavities formed adjacent to said longitudinally extending cavity so that eye shadow and blush products can be housed therein.

5. The hair brush device set forth in claim 4 wherein said handle means includes a second longitudinally extending cavity defined by said two halves so that a lipstick can be housed therein.

6. The hair brush device set forth in claim 5 wherein said handle means includes a third longitudinally extending cavity defined by said two halves so that a mascara tube can be housed therein.

* * * * *